US007292196B2

(12) United States Patent
Waterhouse

(10) Patent No.: US 7,292,196 B2
(45) Date of Patent: Nov. 6, 2007

(54) SYSTEM AND APPARATUS FOR A WIDEBAND OMNI-DIRECTIONAL ANTENNA

(75) Inventor: Rodney B. Waterhouse, Columbia, MD (US)

(73) Assignee: Pharad, LLC, Baltimore, MD (US)

( * ) Notice: Subject to any disclaimer, the term of this patent is extended or adjusted under 35 U.S.C. 154(b) by 0 days.

(21) Appl. No.: 11/212,722

(22) Filed: Aug. 29, 2005

(65) Prior Publication Data

US 2007/0046556 A1 Mar. 1, 2007

(51) Int. Cl.
*H01Q 13/10* (2006.01)

(52) U.S. Cl. ..... 343/770; 343/767; 343/771

(58) Field of Classification Search ..... 343/767, 343/770, 771

See application file for complete search history.

(56) References Cited

U.S. PATENT DOCUMENTS

| | | | | |
|---|---|---|---|---|
| 4,658,262 | A | 4/1987 | DuHamel | 343/792.5 |
| 5,227,808 | A * | 7/1993 | Davis | 343/915 |
| 5,748,153 | A * | 5/1998 | McKinzie et al. | 343/767 |
| 6,246,377 | B1 * | 6/2001 | Aiello et al. | 343/770 |
| 6,414,645 | B1 * | 7/2002 | Dahlberg | 343/767 |
| 6,424,309 | B1 | 7/2002 | Johnston et al. | 343/767 |
| 6,429,819 | B1 | 8/2002 | Bishop et al. | 343/725 |
| 6,518,931 | B1 | 2/2003 | Sievenpiper | 343/770 |
| 6,538,614 | B2 * | 3/2003 | Fleming et al. | 343/767 |
| 6,762,729 | B2 | 7/2004 | Egashira | 343/767 |
| 6,842,154 | B1 * | 1/2005 | Apostolos | 343/767 |
| 2006/0256024 | A1 * | 11/2006 | Collinson | 343/770 |

* cited by examiner

*Primary Examiner*—Tan Ho
(74) *Attorney, Agent, or Firm*—MH2 Technology Law Group, LLP

(57) ABSTRACT

Embodiments generally relate to an antenna. The antenna includes at least two slot radiators, where each slot radiator has an input port and a profile that has been defined to optimize the return loss bandwidth of the antenna. The antenna also includes a transmission line and a circuit configured to connect the transmission line and the at least two slot radiators at the respective input ports. The circuit is also configured to match the impedance of the at least two slot radiators and the co-planar waveguide.

20 Claims, 7 Drawing Sheets

SYSTEM AND APPARATUS FOR A WIDEBAND OMNI-DIRECTIONAL ANTENNA

FIELD

This invention relates generally to radio frequency communications. More particularly, the invention relates to a system and apparatus for a wideband omni-directional antenna.

DESCRIPTION OF THE RELATED ART

Wideband, low profile, omni-directional, small, efficient radiators are generally desired for many applications. These applications may range from military broadband single feed platforms, for example the Joint Tactical Radio System ("JTRS") terminals, to multi-service wireless base stations. The JTRS systems are configured to be a multi-channel, multimode, and reprogrammable radio systems. Accordingly, the JTRS may likely require an antenna capable of receiving signals over a large bandwidth.

Possible solutions to requirements of the JTRS solution are spiral and Beverage antennas. Spiral and Beverage antennas typically offer a large bandwidth. However, there are drawbacks and disadvantages. For example, these antennas suffer from a lack of efficiency due to the resistive nature of the loading. Moreover, the efficiency of these types of antennas may drop even further as the size the antennas becomes smaller.

Log periodic based antennas and complementary antennas may also provide wideband efficient solution. However, their overall sizes (tens of wavelengths and multiple numbers of wavelengths, respectively) make these classes of antennas unwieldy. Moreover, complementary antennas may require complicated feed networks that can reduce their effective bandwidth.

Tapered slot antennas are another possible solution. Tapered slot antennas can perform over multiple octaves. However, like the previously mentioned antennas, tapered slot antennas can suffer from drawbacks and disadvantages. For instance, these antennas are typically electrically large and directional in nature.

Conventional bow tie antennas currently do not have sufficient bandwidth to support the services described earlier. Moreover, conventional bow tie antennas suffer from the requirement of having a complicated feed structure.

SUMMARY

An illustrative embodiment generally relates to an antenna. The antenna includes at least two slot radiators, where each slot radiator has an input port and a profile that has been defined to optimize the return loss bandwidth of the antenna. The antenna also includes a transmission line and a circuit configured to connect the transmission line and the at least two slot radiators at the respective input ports. The circuit is also configured to match the impedance of the at least two slot radiators and the co-planar waveguide.

Another embodiment pertains generally to an antenna. The antenna includes at least two slot radiators, where each slot radiator having an input port. The antenna also includes a transmission line and a circuit configured to connect the transmission line and the at least two slot radiators at the respective input ports. The circuit is also configured to match the impedance of the at least two slot radiators and the transmission line. Moreover, the at least two slot radiators, the transmission line, and circuit are formed on a three-dimensional substrate.

BRIEF DESCRIPTION OF THE DRAWINGS

Various features of the embodiments can be more fully appreciated as the same become better understood with reference to the following detailed description of the embodiments when considered in connection with the accompanying figures, in which.

DETAILED DESCRIPTION OF EMBODIMENTS

For simplicity and illustrative purposes, the principles of the present invention are described by referring mainly to exemplary embodiments thereof. However, one of ordinary skill in the art would readily recognize that the same principles are equally applicable to, and can be implemented in, all types of radio frequency communication systems, and that any such variations do not depart from the true spirit and scope of the present invention. Moreover, in the following detailed description, references are made to the accompanying figures, which illustrate specific embodiments. Electrical, mechanical, logical and structural changes may be made to the embodiments without departing from the spirit and scope of the present invention. The following detailed description is, therefore, not to be taken in a limiting sense and the scope of the present invention is defined by the appended claims and their equivalents.

Embodiments relate generally to a system and apparatus for wideband omni-directional antenna that may be created from a series of slot radiators. The profile of the slot radiators are optimized to efficiently impedance match and efficiency match the antenna. More particularly, in various embodiments, a wideband omni-directional antenna may be fabricated from two slot radiators in a back-to-back configuration. Each slot radiator may be configured to receive power from a common point. The power may be distributed reactively to each slot radiator. In other embodiments, a resistive network may be use balanced with a reduction in efficiency. Each slot radiator may be further configured to optimize the return loss seen at its input terminal and to maximize the radiation efficiency.

Figure 1:
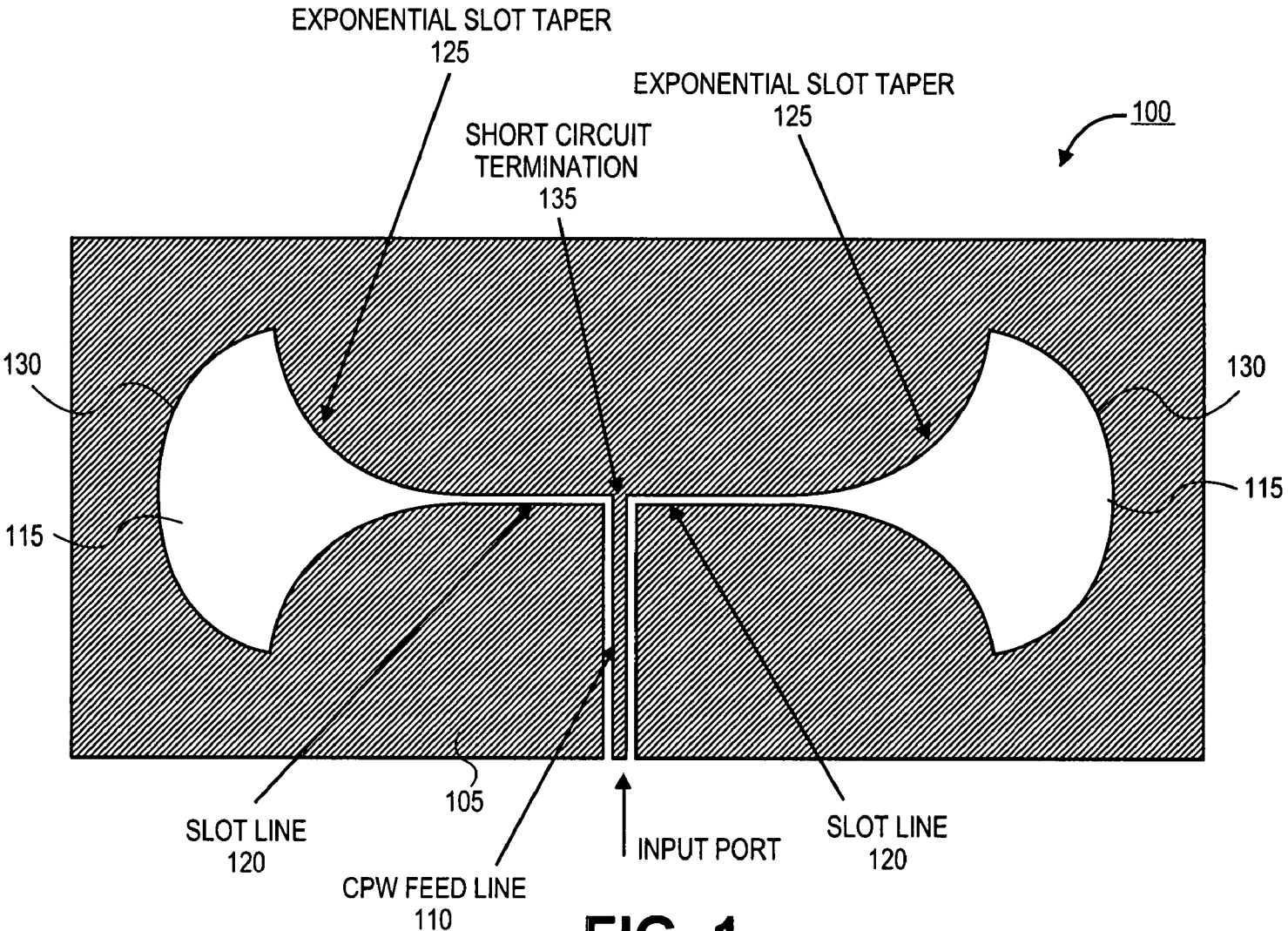
FIG. 1 illustrates an exemplary block diagram of a system in accordance with an embodiment of the invention.

FIG. 1 illustrates a bow tie antenna in accordance with an embodiment of the invention. It should be readily apparent to those of ordinary skill in the art that the bow tie antenna 100 depicted in FIG. 1 represents a generalized schematic illustration and that other components may be added or existing components may be removed or modified.

As illustrated in FIG. 1, the bow tie antenna 100 includes a co-planar waveguide (labeled as "CPW" in FIG. 1) feed line 110 and radiators 115. Radiators 115 include slot lines 120, exponential slot taper 125 and parabolic slot closures 130. The CPW feed line may be configured to guide radio frequency (RF) waves to and from a transceiver (not shown). In one embodiment, the CPW feed line 110 may be designed for 50 Ω. The CPW feed 110 may also be configured to terminate with a short circuit termination 135 at the input ports of the radiators 115. The short circuit termination 135 may also be configured to match the impedances of the slot-lines (in parallel) 120 to that of the impedance of the CPW feed 110. The impedance of the parallel slot lines 120 may be designed to split power equally between the two slot feed sections (100 Ω), and thus provide for a simple and efficient feed network. In some embodiments, the impedance values may be altered to optimize the overall radiation patterns. For example, if twice the power is wanted to be directed towards one of the radiators, then the impedance of this slot line would be half that of the other slot line. The parallel addition of the two slot lines must be equal to the input feed line value (in the case presented here 50 Ω) to ensure that the efficiency of the antenna is optimized. In this case, one slot line would have an impedance of 75 Ω (the one directing more power) and the other would have an impedance of 150 Ω. Such a distribution would ensure twice as much power is radiated from one of the slots as the other.

In this embodiment, each radiator 115 may be configured in a substantially half-bow tie configuration. Each radiator 115 may have a profile that is exponential (see exponential slot taper 125) to minimize the reflection power to the input port. In other embodiments, the profile may be linear, piece-wise linear, or other geometric configuration. The length and width of the taper may be a function of the lowest frequency required for operation and the amount of area available for the overall structure. In most embodiments, the dimensions of the taper should be at least $0.2\lambda_0$ (where the wavelength $\lambda_0$ corresponds to lowest frequency of operation of the antenna 100) to provide an efficient low return loss solution.

The profile of the slot closure 130 of each radiator 115 may have a substantially parabolic configuration. However, in other embodiments, the profile may be exponential, linear, piece-wise linear, or some other geometric configuration.

The antenna 100 may be implemented by creating the CPW feed 110 and the radiators 115 on a common substrate 105. The conductors may be etched on one side of the substrate 105 using standard printed circuit board fabrication processes. Common materials that can be used to develop the antenna (but is not limited to) include polyethylene, polyimide, FR4, silicon and Teflon.

Figure 2:
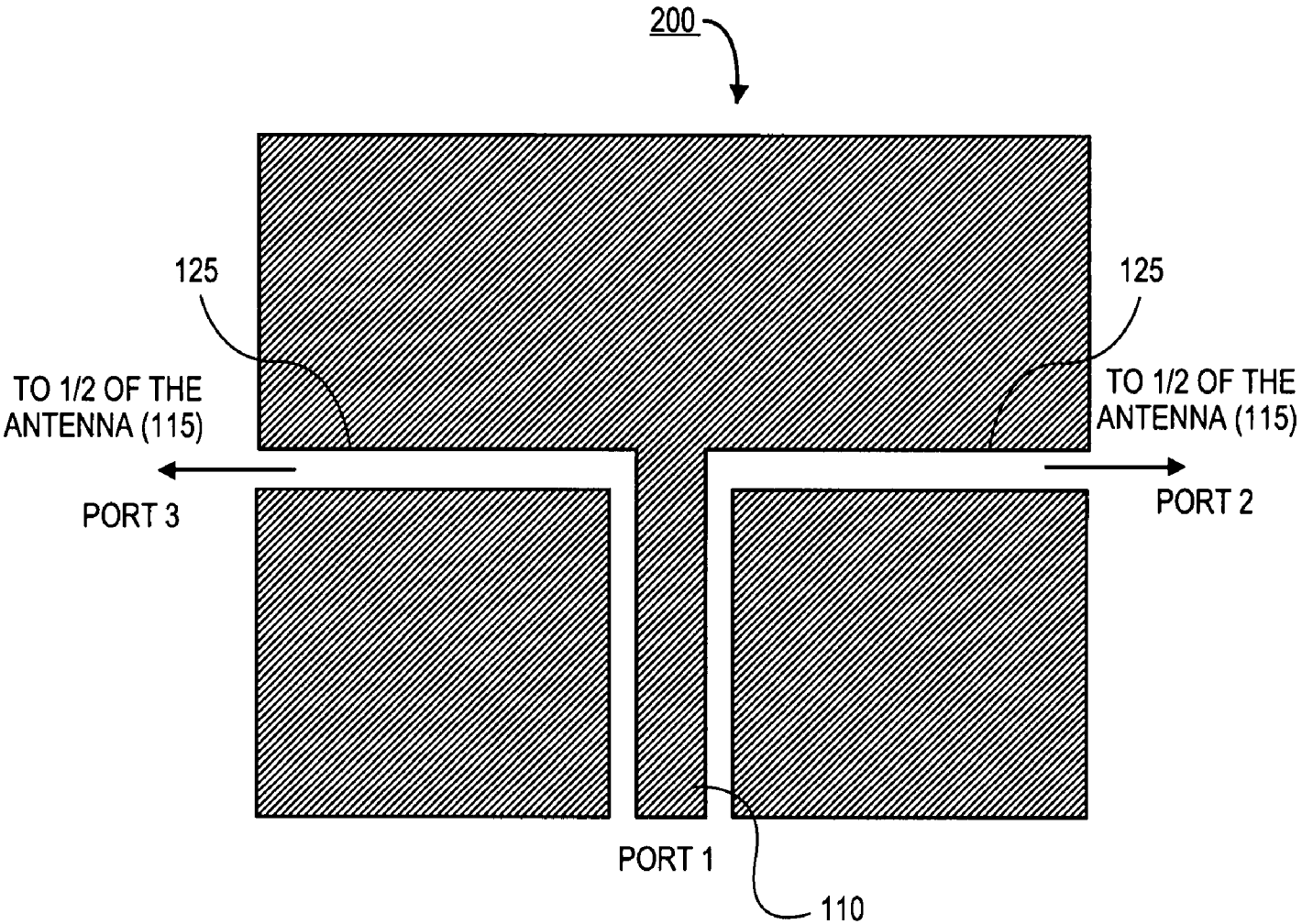
FIG. 2 illustrates a more detailed block diagram of the feed circuit in accordance with an embodiment of the invention.

FIG. 2 illustrates a more detailed block diagram of the feed circuit 200 in accordance with an embodiment of the invention. It should be readily apparent to those of ordinary skill in the art that the circuit 200 depicted in FIG. 2 represents a generalized schematic illustration and that other components may be added or existing components may be removed or modified.

As shown in FIG. 2, the feed circuit 200 includes a CPW feed 110 that may be configured to be 50 Ω and the parallel slot lines 125 of the radiators 115 may be configured to be 100 Ω. As a result, the resulting circuit is a power divider where the impedance ratio may then be used to distribute the power efficiently.

Figure 3:
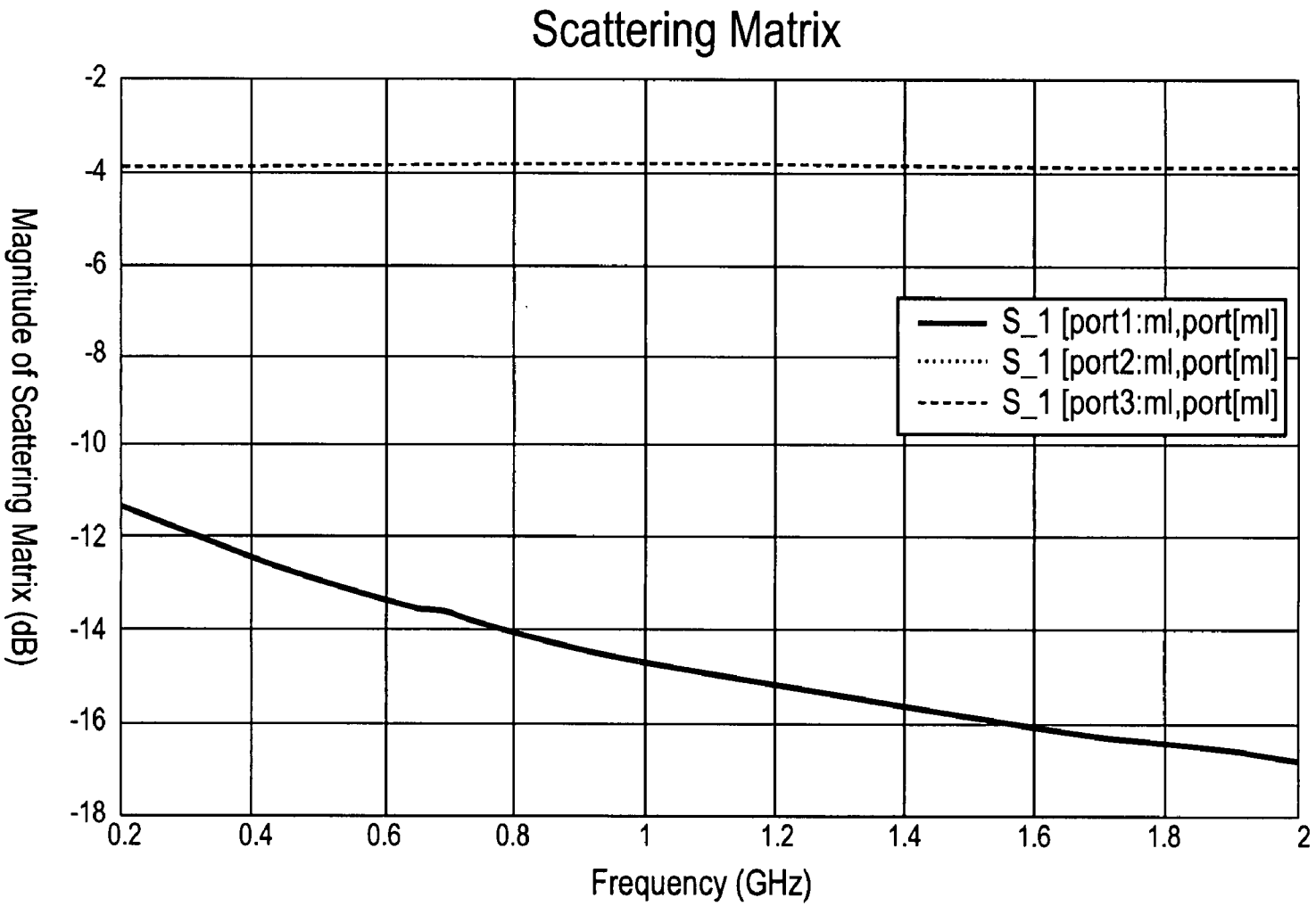
FIG. 3 illustrates a scattering matrix of an embodiment of the feed.

FIG. 3 shows an example of a simulated junction. In FIG. 3, the power distributed to the two antenna ports is plotted (ports 2 and 3) as well as the reflected signal at the input port (port 1 in FIG. 3). As can be seen from this plot, the junction is well matched from 0.2-3 GHz and the power is evenly distributed to the two antenna ports in an efficient manner. In other embodiments, a double Y balun may be used to interface the CPW feed line and the slot lines.

Returning to FIG. 2, although the embodiment shown here shows a transition from the CPW feed 110 to a slot-line, other technologies transitioning slot-line to slot-line, microstrip to slot-line, coaxial cable to slot or combination thereof may be implemented in other embodiments.

Figure 4:
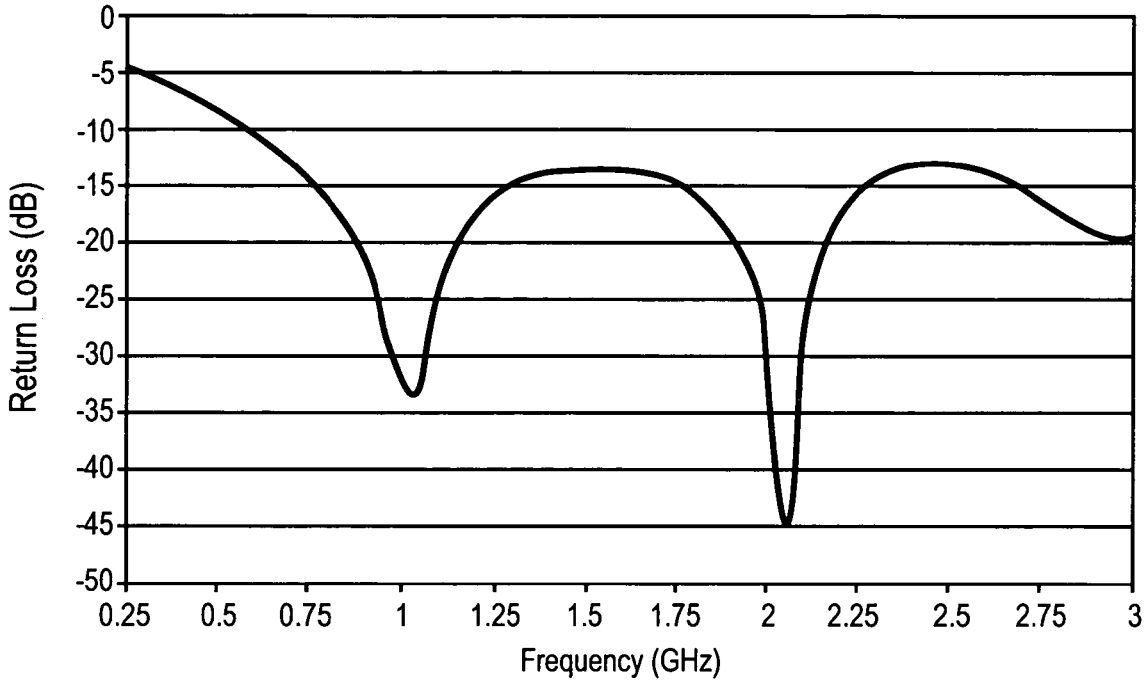
FIG. 4 illustrates a return loss performance for an embodiment.

FIG. 4 illustrates a return loss performance of an embodiment designed for operating at a minimum frequency of 500 MHz. As shown in FIG. 4, the frequency response the antenna is well matched from 500 MHz to beyond 3 GHz highlighting the inherent wideband nature of the antenna. The impedance response is more than satisfactory and is due to the matching circuit between the feed port and the two radiators, as previously described, as well as the profiles used to realize the slot antenna.

Figure 5A:
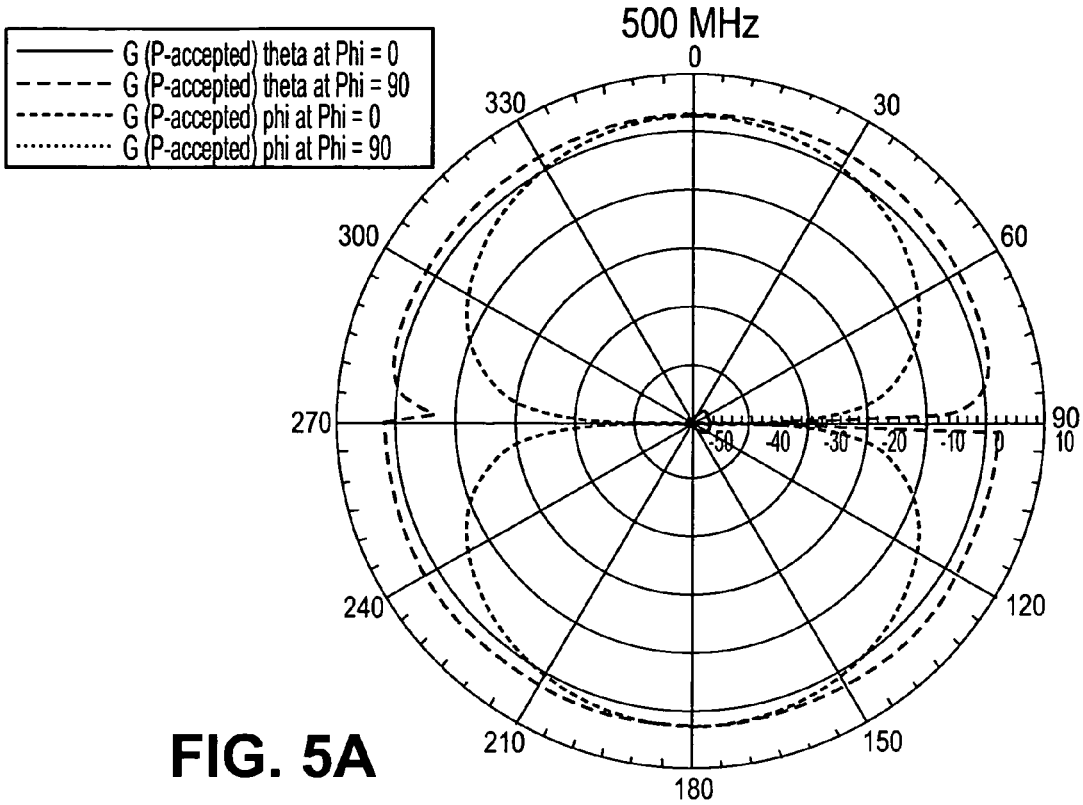
FIG. 5A illustrates a radiation pattern for an embodiment at 500 MHz.
Figure 5B:
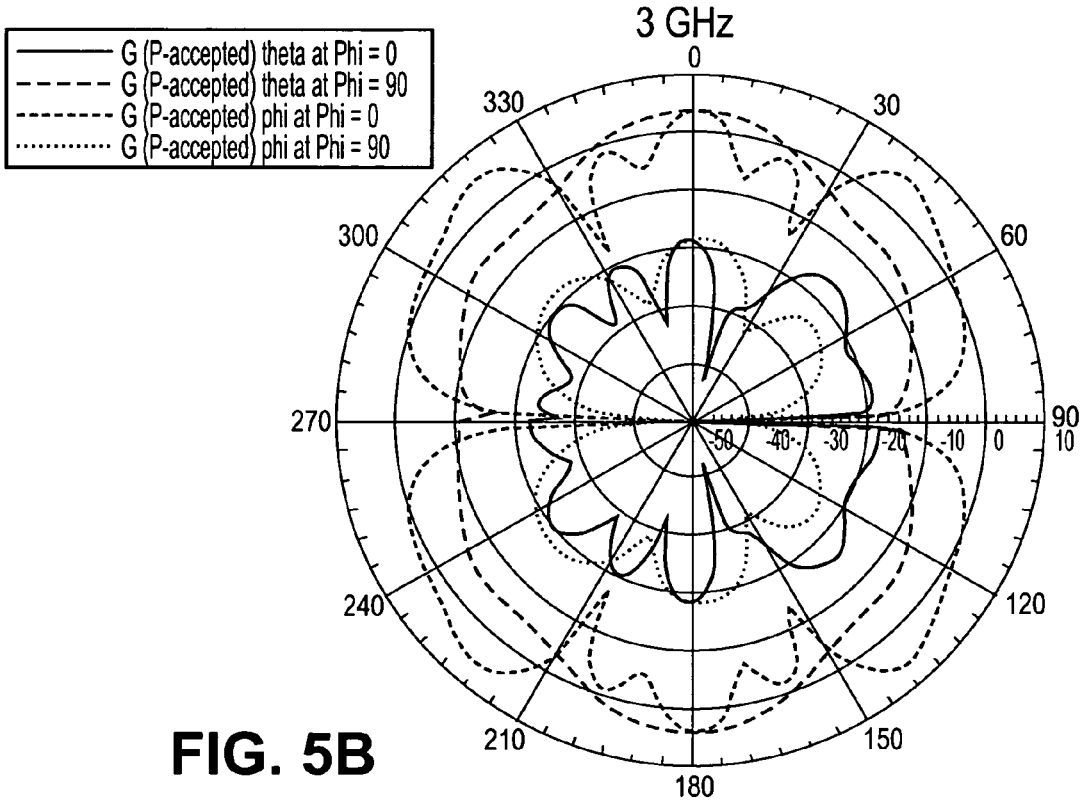
FIG. 5B illustrates a radiation pattern for an embodiment at 3 GHz.

FIGS. 5A and 5B illustrate a radiation pattern for the embodiment at 500 MHz and 3 GHz, respectively. As shown in FIGS. 5A-B, the radiation patterns are near-omni-directional in nature and the gain is greater than 0 dBi. This result shows that an efficient, wideband radiator can be achieved without resorting to resistive loading of the antenna, as for the cases of a spiral or Beverage antenna.

Figure 6:
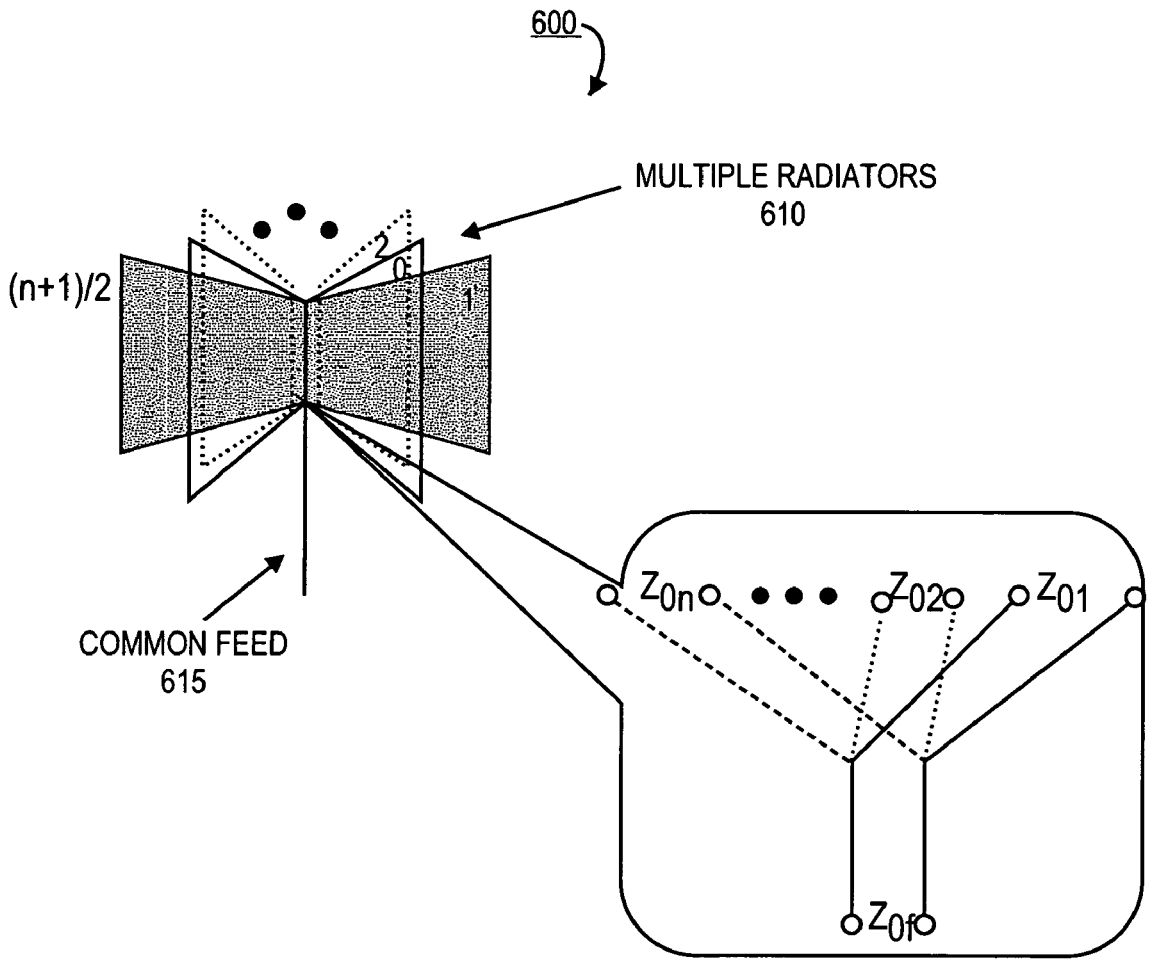
FIG. 6 illustrates another embodiment.

FIG. 6 illustrates a bow tie antenna 600 in accordance with yet another embodiment. It should be readily apparent to those of ordinary skill in the art that the bow tie antenna 600 depicted in FIG. 6 represents a generalized schematic illustration and that other components may be added or existing components may be removed or modified.

As shown in FIG. 6, the antenna 600 includes n radiators 610. The radiators 610 may be configured to be in a substantially bow tie antenna configuration in this embodiment. Here the power is fed to the n/2 antenna elements (n is an integer that can range from two to a very large number) at a common feed 615. The power is divided reactively to each half of the radiator in order to maximize efficiency (a close-up of the common 615 feed arrangement is shown as an inset in FIG. 6), although a resistive network could also be used at the expense of reducing the overall efficiency. In principle, the more radiators that are incorporated into the entire radiating structure, the more degrees of freedom that result in terms of radiation pattern control and gain. Each element of the combined radiator is optimized to minimize the return loss seen at its input terminal as well as maximize the radiation efficiency.

Figure 7:
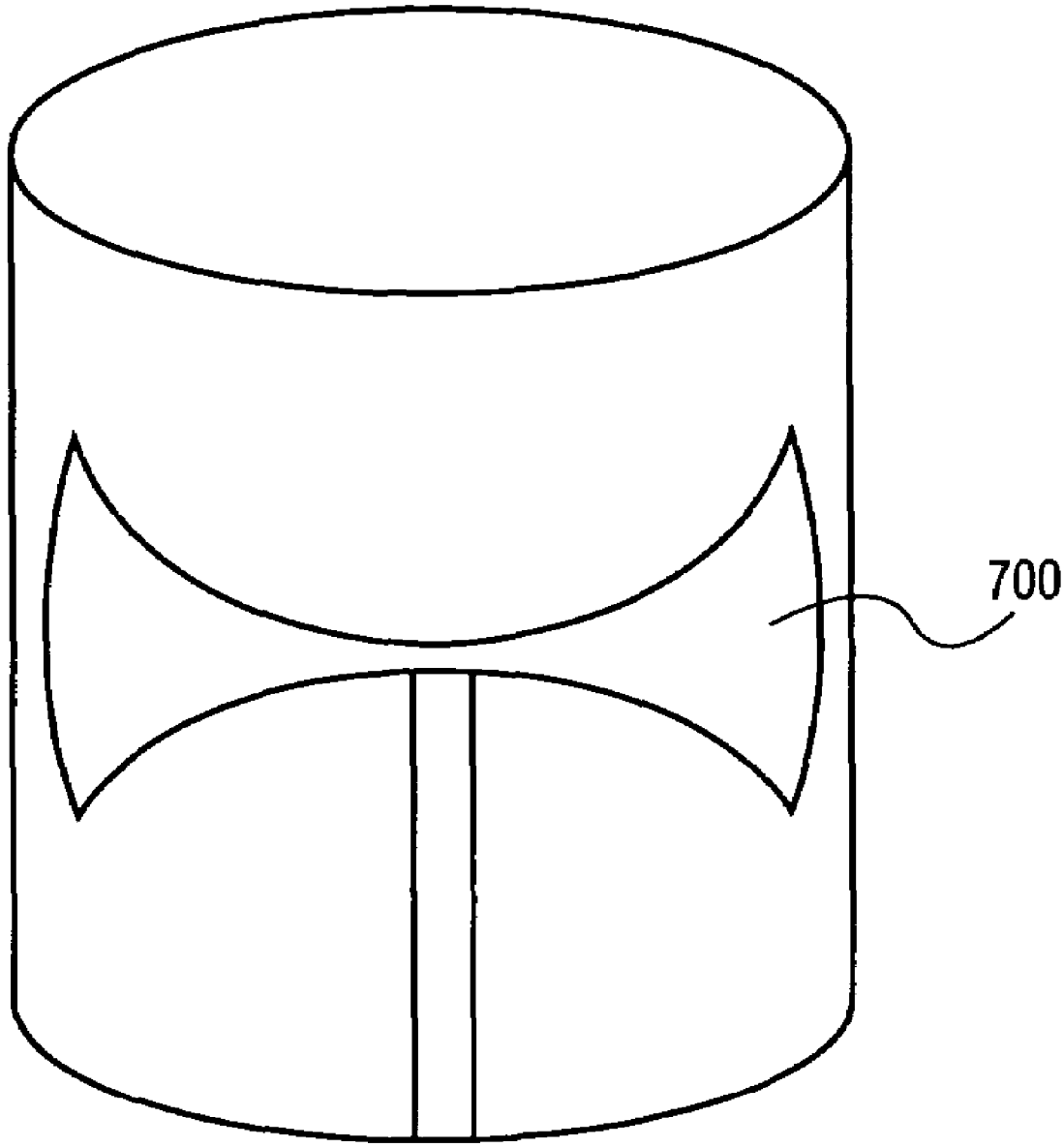
FIG. 7 illustrates yet another embodiment.

It should be noted that the proposed radiator is not limited to planar geometries. The radiator can also be formed on a variety of three-dimensional structures including cylinders, spheres and cones, as shown in FIG. 7. As shown in FIG. 7, this embodiment of the bow-tie antenna 700 is formed on a three-dimensional surface. For example, bow-tie antenna 700 may be grown on the surface of a substrate in the form of cylinder. In addition, to achieve a low profile version of the radiator, the antenna assembly can be integrated with an absorbing material or artificial magnetic conductors.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5.

While the invention has been described with reference to the exemplary embodiments thereof, those skilled in the art will be able to make various modifications to the described embodiments without departing from the true spirit and scope. The terms and descriptions used herein are set forth by way of illustration only and are not meant as limitations. In particular, although the method has been described by examples, the steps of the method may be performed in a different order than illustrated or simultaneously. Those skilled in the art will recognize that these and other variations are possible within the spirit and scope as defined in the following claims and their equivalents.

What is claimed is:

1. An antenna comprising:

at least two slot radiators, each slot radiator having an input port and a slot line;

a transmission line; and a short circuit termination configured to connect the transmission line and the at least two slot radiators at their respective input ports, wherein the short circuit termination and the slot lines are also configured to match the impedance of the at least two slot radiators and the transmission line and optimize the distribution of power among the radiators.

2. The antenna according to claim 1, wherein the each slot radiator is further configured to have a taper profile.

3. The antenna according to claim 2, wherein the taper profile is configured to be one of exponential in shape and linear pieces.

4. The antenna according to claim 2, wherein a length and a width of the taper profile may be configured to be at least 0.2 times the wavelength.

5. The antenna according to claim 1, wherein the transmission line is a co-planar waveguide.

6. The antenna according to claim 1, wherein each slot radiator includes a slot closure.

7. The antenna according to claim 6, wherein the slot closure is configured to be substantially parabolic.

8. The antenna according to claim 6, wherein the slot closure is configured to be one of substantially exponential, linear, and piece-wise linear.

9. The antenna according to claim 1, wherein the transmission line is one of a co-planar waveguide and a co-planar waveguide equivalent and the at least two slot radiators and the co-planar waveguide are implemented on a common substrate.

10. The antenna according to claim 1, wherein a distribution of power is split reactively between the at least two slot radiators.

11. An antenna comprising:

at least two slot radiators, each slot radiator having an in put port and a slot line;

a transmission line; and a short circuit termination configured to connect the transmission line and the at least two slot radiators at their respective input ports, wherein the short circuit termination and slot lines are also configured to match the impedance of the at least two slot radiators and the transmission line and the at least two slot radiators, the transmission line, and circuit formed on a three-dimensional substrate, and optimize the distribution of power among the radiators.

12. The antenna according to claim 11, wherein the each slot radiator is further configured to have a taper profile.

13. The antenna according to claim 12, wherein the taper profile is configured to be one of an exponential in shape or linear pieces.

14. The antenna according to claim 12, wherein a length and a width of the taper profile may be configured to be at least 0.2 times the wavelength.

15. The antenna according to claim 11, wherein the transmission line is a coplanar waveguide, or equivalent.

16. The antenna according to claim 11, wherein each slot radiator includes a slot closure.

17. The antenna according to claim 16, wherein the slot closure is configured to be substantially parabolic.

18. The antenna according to claim 16, wherein the slot closure is configured to be one of substantially exponential, linear, and piece-wise linear.

19. The antenna according to claim 11, wherein a distribution of power is split reactively between the at least two slot radiators.

20. An antenna comprising:

at least two slot radiators, each slot radiator having an input port;

a transmission line; and a circuit configured to connect the transmission line and the at least two slot radiators at the respective input ports, wherein the circuit is also configured to match the impedance of the at least two slot radiators and the transmission line and the at least two slot radiators, the transmission line, and circuit formed on a three-dimensional substrate, wherein the three dimensional substrate is a cylinder.

* * * * *